US006051107A

United States Patent [19]

Varnell

[11] Patent Number: 6,051,107

[45] **Date of Patent: *Apr. 18, 2000**

[54] PROCESS FOR SURFACE SIZING PAPER AND PAPER PREPARED THEREBY

[75] Inventor: Daniel Felix Varnell, New Castle County, Del.

[73] Assignee: Hercules Incorporated, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/847,841

[22] Filed: Apr. 28, 1997

[51] Int. Cl.[7] ..... D21H 19/00

[52] U.S. Cl. ..... 162/135; 162/168.1; 162/168.7; 162/169; 162/136

[58] Field of Search ..... 162/158, 168.1, 162/168.7, 169, 135, 136; 526/312, 317.1, 318, 319, 329.5, 329.7

[56] References Cited

U.S. PATENT DOCUMENTS

| | | | |
|---|---|---|---|
| 2,790,735 | 4/1957 | McLaughlin et al. | 117/155 |
| 3,061,472 | 10/1962 | Brockway | 117/139.5 |
| 3,242,121 | 3/1966 | Hill | 260/29.6 |
| 3,297,614 | 1/1967 | Pueschner et al. | 260/29.6 |
| 3,477,871 | 11/1969 | van Westrenen | 117/155 |
| 3,875,099 | 4/1975 | Kurth et al. | 260/29.6 |
| 4,040,900 | 8/1977 | Mazzarella et al. | 162/158 |
| 4,070,319 | 1/1978 | Carel et al. | 260/29.4 |
| 4,279,794 | 7/1981 | Dumas | 260/29.2 |
| 4,434,269 | 2/1984 | Probst et al. | 524/538 |
| 4,464,524 | 8/1984 | Karickhoff | 526/313 |
| 4,521,494 | 6/1985 | Mani | 428/514 |
| 4,659,431 | 4/1987 | Probst et al. | 162/168.2 |
| 4,898,787 | 2/1990 | Min et al. | 428/480 |
| 5,116,924 | 5/1992 | Bung et al. | 526/312 |
| 5,169,886 | 12/1992 | Bung et al. | 524/238 |
| 5,266,165 | 11/1993 | DeClercq et al. | 162/168.2 |
| 5,397,619 | 3/1995 | Kuroyama et al. | 428/141 |
| 5,591,489 | 1/1997 | Dragner et al. | 427/364 |
| 5,663,224 | 9/1997 | Emmons et al. | 524/188 |

FOREIGN PATENT DOCUMENTS

| | | |
|---|---|---|
| 0629741 A1 | 12/1994 | European Pat. Off. . |
| 0666368 A3 | 8/1995 | European Pat. Off. . |
| 08246391 | 12/1994 | Japan . |
| 10046490 | 2/1998 | Japan . |
| 786543 | 11/1957 | United Kingdom . |
| 903416 | 8/1962 | United Kingdom . |
| 1356030 | 6/1974 | United Kingdom . |
| 1373788 | 11/1974 | United Kingdom . |
| 1533434 | 11/1978 | United Kingdom . |
| WO 96/34699 | 11/1996 | WIPO . |

OTHER PUBLICATIONS

Paper Acceptance Criteria for Hewlett–Packard DeskJect 500C, 550C & 560 Printers, 1994, pp. 1–32.

E. Strazdins, "The Sizing of Paper, Second Edition," edited by W. F. Reynolds, Tappi Press, 1989, pp. 1–33.

C. E. Farley and R. B. Wasser, "The Sizing of Paper, Second Edition," edited by W. F. Reynolds, Tappi Press, 1989, pp. 51–62.

Tappi Standard T530, 1989—"Size Test for Paper by Ink Resistance.".

"Pulp and Paper Chemistry and Chemical Technology", vol. 3, J.P. Casey, Ed. (1998), pp. 1553–1554.

Hercules Product Data, "Chromaset™ Surface Sizing Treatment," No. 7657, 1996.

*Primary Examiner*—Peter Chin
*Assistant Examiner*—Steven B. Leavitt
*Attorney, Agent, or Firm*—Martin F. Sloan

[57] ABSTRACT

A process for preparing sized paper which incorporates in the paper a size composition containing polymer latex, wherein the polymer contained in the polymer latex is anionic polymer having properties selected from the group consisting of $T_G$ about −15° C. to about 50° C. and acid number about 30 to about 100, and wherein the polymer latex has a zeta potential of from about −25 to about −70 millivolts over the pH range of about 5 to about 9. A preferred process has the steps: a) providing an aqueous pulp suspension; b) sheeting and drying the aqueous pulp suspension to obtain paper; c) treating the paper by applying to at least one surface of it the size composition containing polymer latex and starch; and d) drying the paper to obtain sized paper. Preferred anionic polymers are copolymers of monomers comprising styrene or substituted styrene, alkyl acrylate or methacrylate and ethylenically unsaturated carboxylic acid.

38 Claims, No Drawings

PROCESS FOR SURFACE SIZING PAPER AND PAPER PREPARED THEREBY

FIELD OF THE INVENTION

This invention relates to a process for sizing paper and to paper prepared by the process.

BACKGROUND OF THE INVENTION

Surface sizing, i.e., the addition of sizing agents to the surface of a paper sheet that has been at least partially dried, is widely practiced in the paper industry, particularly for printing grades. Surface sizing leads to paper with improved water holdout (sizing), improved print quality, and increased toner adhesion. The most widely used surface sizing agent is starch, which is used to enhance the surface characteristics of the sheet, particularly for the purposes of controlling ink receptivity and porosity, and of increasing surface strength.

The growing use of ink jet printing, which generally uses aqueous-based inks, has placed more stringent requirements on paper properties, because the inks must provide printed characters with high optical density, minimal spread (also referred to as feathering or bleed) and sharp or clean edges (also referred to as wicking or edge roughness). The surface characteristics of the printing paper have been found to be a primary influence on these qualities of ink jet printing.

Polymer latexes are used for several functions in paper making processes. They are used as pigment binders for paper coatings, for paper saturants, as dispersing aids for other paper additives, and as sizing agents.

The paper coating process is completely different in function, composition and requirements when compared to surface sizing processes. Paper coating compositions have much higher viscosities than surface sizing compositions, and thus cannot be readily applied by a size press on a typical paper machine. Paper coatings contain pigment at 3 to 20 times higher than the level of polymeric binder; whereas in a typical surface size, pigments are optional, and if used, are present at levels less than the amount of polymeric binder.

The polymer latexes that have been used for sizing are cationic latexes. For example, U.S. Pat. No. 4,434,269 discloses sizing agents for paper that are copolymers of acrylonitrile or methacrylonitrile, $C_1$–$C_{12}$ alkyl esters of acrylic acid and/or methacrylic acid. The copolymers are emulsified with a cationic polymeric emulsifier containing N,N'-dimethylaminoethyl acrylate or methacrylate, styrene, and acrylonitrile monomers.

U.S. Pat. No. 4,659,431 discloses sizing agents for paper that are copolymers of acrylonitrile or methacrylonitrile, styrene, and acrylates or methacrylates having 1 to 12 carbon atoms in the alcohol radical. The copolymers are emulsified with a cationic polymeric emulsifier containing monomers consisting of N,N'-dimethylaminoethyl acrylate or methacrylate, styrene, and acrylonitrile.

U.S. Pat. Nos. 5,116,924 and 5,169,886 disclose sizing agent dispersions containing cationic dispersant produced from the monomers: N,N'-dimethylaminoethyl acrylate and/or methacrylate; an acrylic and/or methacrylic acid ester of a $C_{10}$ to $C_{22}$ fatty alcohol; methyl acrylate and/or methacrylate; acrylic acid and/or methacrylic acid; and optionally butyl acrylate and/or butyl methacrylate and isobutyl acrylate and/or isobutyl methacrylate.

SUMMARY OF THE INVENTION

A process for preparing sized paper comprises incorporating in the paper a size composition comprising polymer latex, wherein the polymer contained in the polymer latex is anionic polymer having properties selected from the group consisting of $T_G$ about −15° C. to about 50° C. and acid number about 30 to about 100, and wherein the polymer latex has a zeta potential of about −25 to about −70 millivolts over the pH range of about 5 to about 9.

A process for preparing sized paper comprises: a) providing an aqueous pulp suspension; b) sheeting and drying the aqueous pulp suspension to obtain paper; c) applying to at least one surface of the paper an aqueous size composition comprising polymer latex; and d) drying the paper to obtain sized paper, wherein the polymer contained in the polymer latex is anionic polymer having properties selected from the group consisting of $T_G$ about −15° C. to about 50° C. and acid number about 30 to about 100, and wherein the polymer latex has a zeta potential of about −25 to about −70 millivolts over the pH range of about 5 to about 9.

Paper surface sized by the process of the invention performs better in ink jet printing than does paper that is the same except that it does not contain the size composition, when the printing is evaluated for at least one property selected from the group consisting of optical density, feathering, wicking, edge roughness and bleed.

DETAILED DESCRIPTION OF THE INVENTION

The polymer contained in the polymer latex utilized in the processes of this invention is characterized by glass transition temperature ($T_G$) and acid number. The polymer latex itself is characterized in terms of its zeta potential and particle size.

The $T_G$ of the polymer is in the range of from about −15° C. to about 50° C. Preferably it is from about 5° C. to about 35° C., and more preferably from about 20° C. to about 30° C.

The acid number of the copolymer is from about 30 to about 100, preferably from about 40 to about 75, and more preferably from about 45 to about 55. Some portion of the acidic groups may be in the form of salts with alkali or alkaline earth metals or ammonia.

The zeta potential is the potential across the interface of solids and liquids, specifically, the potential across the diffuse layer of ions surrounding a charged colloidal particle which is largely responsible for colloidal stability. Zeta potentials can be calculated from electrophoretic mobilities, namely, the rates at which colloidal particles travel between charged electrodes placed in the dispersion, emulsion or suspension containing the colloidal particles. A zeta potential value of zero to −10 millivolts will be an indicator of poor stability. A zeta potential value of −10 to −19 millivolts is an indicator of some, but usually insufficient stability. A zeta potential value of at least −20 millivolts, and preferably −25 to 40 millivolts is an indication of a moderate charge with good stability. A zeta potential value of greater than −40 to −100 millivolts or more normally indicates excellent stability.

In the present invention, the polymer latex has a zeta potential of from about −25 to about −70 millivolts over the pH range of about 5 to about 9. Preferably the zeta potential is from about −35 to about −60 millivolts, and more preferably from about −40 to about 55 millivolts. Thus, it is preferred that the charge on the latex should be highly anionic. This corresponds to better electrostatic colloidal stability of the final product.

The average particle size of the polymer in the polymer latex is from about 30 to about 500 nanometers. Preferably it is from about 50 to about 200 nanometers, and more preferably from about 80 to about 150 nanometers.

Polymer latexes for use in the processes of this invention preferably contain anionic copolymer of monomers comprising styrene or substituted styrene, alkyl acrylate or methacrylate and ethylenically unsaturated carboxylic acid.

The alkyl group of the alkyl acrylate or methacrylate preferably contains from 1 to about 12 carbon atoms. Exemplary alkyl acrylates or methacrylates are methyl methacrylate, ethyl acrylate, ethyl methacrylate, propyl acrylate, butyl acrylate, butyl methacrylate, 2-ethylhexyl acrylate, 2-ethylhexyl methacrylate, lauryl acrylate, lauryl methacrylate and mixtures thereof.

Preferable ethylenically unsaturated carboxylic acids for use in the invention are α,β-unsaturated carboxylic acids. Examples are acrylic acid, methacrylic acid, maleic acid or anhydride, fumaric acid and itaconic acid. More preferable ethylenically unsaturated carboxylic acids are acrylic acid and methacrylic acid. The most preferred ethylenically unsaturated carboxylic acid is acrylic acid.

Preferable styrenes or substituted styrenes include styrene, α-methylstyrene and vinyl toluene. Styrene is most preferred.

The preferred polymer latex for use in the processes of this invention is Chromaset™ 600 surface sizing treatment available from Hercules Incorporated, Wilmington, Del. This material has an anionic charge (zeta potential of about −40 mV from pH 6 to 9), a total solids of 46–48% and a pH of 8 to 9.

A process for preparing sized paper comprises incorporating in the paper a size composition comprising the polymer latex described herein. Preferably the process comprises: (a) providing an aqueous pulp suspension; (b) sheeting and drying the aqueous pulp suspension to obtain paper; (c) applying to at least one surface of the paper size comprising polymer latex; and (d) drying the paper to obtain sized paper. Paper sized by processes of this type is known as surface sized paper. Preferably, in surface sizing processes, the size in step (c) is applied from a size press which can be any type of coating or spraying equipment, but most commonly is a puddle, gate roller or metered blade type of size press.

The aqueous pulp suspension of step (a) of the process is obtained by means well known in the art, such as known mechanical, chemical and semichemical, etc., pulping processes. Normally, after the mechanical grinding and/or chemical pulping step, the pulp is washed to remove residual pulping chemicals and solubilized wood components. Either bleached or unbleached pulp fiber may be utilized in the process of this invention. Recycled pulp fibers are also suitable for use.

The sheeting and drying of the pulp suspension is carried out by methods well known in the art. There is a variety of materials which in the commercial practice of making paper are commonly add to the aqueous pulp suspension before it is converted into paper, and may be used in the instant process as well. These include, but are not restricted to, wet strength resins, internal sizes, dry strength resins, alum, fillers, pigments and dyes.

For obtaining the highest levels of surface sizing in the processes of this invention, it is preferred that the sheet be internally sized, that is, that sizing agents be added to the pulp suspension before it is converted to a paper sheet. Internal sizing helps prevent the surface size from soaking into the sheet, thus allowing it to remain on the surface where it has maximum effectiveness.

The internal sizing agents encompass any of those commonly used at the wet end of a fine paper machine. These include rosin sizes, ketene dimers and multimers, and alkenylsuccinic anhydrides. The internal sizes are generally used at levels of from about 0.05 wt. % to about 0.25 wt. % based on the weight of the dry paper sheet.

Methods and materials utilized for internal sizing with rosin are discussed by E. Strazdins in *The Sizing of Paper, Second Edition,* edited by W. F. Reynolds, Tappi Press, 1989, pages 1–33.

Suitable ketene dimers for internal sizing are disclosed in U.S. Pat. No. 4,279,794, which is incorporated by reference in its entirety, and in United Kingdom Patent Nos. 786,543; 903,416; 1,373,788 and 1,533,434, and in European Patent Application Publication No. 0666368 A3. Ketene dimers are commercially available, as Aquapel® and Precis® sizing agents from Hercules Incorporated, Wilmington, Del.

Ketene multimers for use in internal sizes are described in: European Patent Application Publication No. 0629741A1, corresponding to U.S. patent application Ser. No. 08/254,813, filed Jun. 6, 1994; European Patent Application Publication No. 0666368A3, corresponding to U.S. patent application Ser. No. 08/192,570, filed Feb. 7, 1994; and U.S. patent application Ser. No. 08/601,113, filed Feb. 16, 1996.

Alkenylsuccinic anhydrides for internal sizing are disclosed in U.S. Pat. No. 4,040,900, which in incorporated herein by reference in its entirety, and by C. E. Farley and R. B. Wasser in *The Sizing of Paper, Second Edition,* edited by W. F. Reynolds, Tappi Press, 1989, pages 51–62. A variety of alkenylsuccinic anhydrides is commercially available from Albemarle Corporation, Baton Rouge, La.

For surface sizing, the polymer latex is preferably mixed with a solution of starch or starch derivative prior to its application to the paper. The starch may be of any type, including but not limited to oxidized, ethylated, cationic and pearl, and is preferably used in aqueous solution.

The typical size press starch solution preferably contains about 1 to about 20% by weight starch in water with a pH between about 6 and 9. More preferably the it contains from about 3 to about 15% by weight, and most preferably 5 to about 10% by weight starch. Small amounts of other additives may be present as well, e.g., optical brighteners and defoamers. The amount of polymer latex added to the starch solution to form the size press compound is such that the polymer solids level in the final size press compound is preferably from about 0.02 to about 2 wt. %. More preferably the polymer solids level will be from about 0.05 to about 1 wt. %. The final pH of the size press compound should be maintained above about pH 7.

The size press compound is applied at the size press in an amount such that the level of polymer applied to the surface is preferably about 0.02 wt. % to about 0.8 wt. % on a dry basis based on the weight of the dry sheet of paper. More preferably the level is about 0.05 wt. % to about 0.5 wt. %, and most preferably about 0.1 wt. % to about 0.3 wt. %. The amount of starch applied to the sheet is generally about 1 to about 8 wt. %, more preferably about 2 to about 6 wt. %, and most preferably about 3 to about 5 wt. %, on a dry basis based on the weight of the dry sheet of paper.

After application of the surface size, the sheets are dried utilizing any of the conventional drying procedures well known in the paper making art.

Surface sized paper produced by the process of this invention has properties that are substantially improved over those of paper that is the same except that it does not contain the anionic polymer latex. In particular, it is found that the paper of this invention performs better in ink jet printing than does paper that is the same except that it lacks the surface size comprising polymeric latex. The ink jet printing properties include optical density, feathering, wicking, edge roughness and bleed. In addition the paper of this invention demonstrates better toner adhesion than does paper lacking the anionic polymer latex. Moreover, it is found that the water holdout is also improved for the paper of this invention.

For the purposes of this invention ink jet printing is evaluated on the basis of the optical density of the printed characters when black ink is utilized as well as on the amount of ink spread and the sharpness and clarity of the character edges (also known as feathering and wicking). When colored inks are used, the evaluation is on the basis of the edge roughness of the characters and the amount of ink spread (also known as line growth or bleed) that is observed. Toner adhesion is the relative amount of white paper showing through a solid black area of toner applied by a copy machine that results for the paper being creased. Water holdout is measured by well known sizing tests such as, for example, the Hercules sizing test.

This invention is illustrated by the following examples, which are exemplary only and not intended to be limiting. All percentages, parts, etc., are by weight, based on the weight of the dry pulp, unless otherwise indicated.

PROCEDURES

Zeta Potential

The charge on the particles of the latex was determined as the zeta potential measured with a Lazer Zee® Meter model 501. This was carried out by diluting 1 or 2 drops of the dispersion in 100 ml of deionized water and adjusting the pH with NaOH or $H_2SO_4$.

Hercules Size Test

An art-recognized test for measuring sizing performance is the Hercules Size Test, described in *Pulp and Paper Chemistry and Chemical Technology,* J. P. Casey, Ed., Vol. 3, p. 1553–1554 (1981) and in TAPPI Standard T530, the disclosures of which are incorporated herein by reference. The Hercules Size Test determines the degree of water sizing obtained in paper by measuring the change in reflectance of the paper's surface as an aqueous solution of dye penetrates from the opposite surface side. The aqueous dye solution, e.g., naphthol green dye in 1% formic acid, is contained in a ring on the top surface of the paper, and the change in reflectance is measured photoelectrically from the bottom surface.

Test duration is limited by choosing a convenient end point, e.g., a reduction in reflected light of 20%, corresponding to 80% reflectance. A timer measures the time (in seconds) for the end point of the test to be reached. Longer times correlate with increased sizing performance, i.e., resistance to water penetration increases. Unsized paper will typically fail at 0 seconds, lightly sized paper will register times of from about 1 to about 20 seconds, moderately sized paper from about 21 to about 150 seconds, and hard sized paper from about 151 to about 2,000 seconds.

Polymer Glass Transition Temperature ($T_G$)

Determined by differential scanning calorimetry on dry polymer isolated from the latex at a heating rate of 20° C./minute. The inflection point of the temperature vs. heat capacity curve is taken as the $T_G$.

Ink Jet Printing Evaluation

Inkjet printing was tested with a Hewlett Packard Deskjet 560C printer. A Hewlett Packard 3.4 test pattern and method were used to rate the quality of the printing.

Before testing the paper was conditioned at 23° C. and 50% relative humidity for a minimum of one (1) day.

A. Evaluation of Black Ink Print Quality

Optical Density

An optical densitometer was placed over the black test rectangle on the printed sheet, and the optical density for black was recorded. This was repeated on different areas of the rectangle for a total of 6 readings.

Black Ink Spread (Feathering)

Black ink spread is the tendency for the ink to spread out from the print area. Using the magnifier, areas of the test pattern consisting of rows of the letter "E" were examined and the print quality was compared with standard examples of acceptable, good and unacceptable feathering. Specific areas that were examined were: degree of rounding of the square ends of the letter; amount of separation between the center stroke and the right ends of the letter, general breadth of the lines, etc. Similar inspection of line growth was made using the vertical and horizontal black lines in the test pattern.

Black Edge Roughness (Wicking)

Black edge roughness or wicking is the tendency for the ink to bleed away from the print area along a fiber or one direction, causing rough edges, even long "spidery" lines on the periphery of the print area. Using the magnifier, all areas of the test pattern where black lines are printed against a white background were examined and compared with the standard examples of acceptable, good and unacceptable wicking.

B. Evaluation of Color Print Quality

Optical Density

The optical densitometer was positioned over the composite black rectangle on the printed sheet, and the black optical density number was recorded. The composite black print consisted of a combination of cyan, magenta and yellow inks. The procedure was repeated on different areas of the rectangle for a total of 6 readings which were averaged and reported as composite black optical density.

Color—Color Edge Roughness

Color—color edge roughness measures the roughness of lines in areas where two colors overlap. Areas of the test pattern where composite black and yellow areas overlap were examined with a magnifier and compared with standard examples to judge whether the print quality was acceptable, good or unacceptable.

Color—Color Line Growth

Color—color line growth examines the size of printed features of one color touching or overlapping another color versus the intended size. A magnifier was used to examine the overlapping color text areas of the test pattern and to compare them with standard examples as acceptable, good or non-acceptable. Specifically, the size of composite black characters on a yellow background was examined.

Toner Adhesion

Relative toner adhesion is the relative amount of white paper showing through a solid black area of toner, applied by a copy machine, that results from the paper being creased. For the test, the paper was creased in a controlled fashion (toner on the inside of the crease), was unfolded, and then the loose toner was removed in a reproducible manner.

The percentage of the crack area from which toner was lost was estimated by microscopic or optical density measurement of the crack and surrounding areas of toner, and reported as the toner adhesion value. Thus, a smaller value means that less toner is lost thus indicating greater toner adhesion.

EXAMPLE 1

This example illustrates surface sizing with anionic latex, Chromase™ 600, surface sizing treatment, available from Hercules Incorporated, Wilmington, Del. The latex (47% solids) had a zeta potential of approximately −40 mV from pH 6 to 9, and an average particle size of approximately 100 nm. Polymer isolated from the latex by drying had $T_G$ of approximately 25° C.

Paper was prepared on a commercial paper machine using the following procedures and conditions.

Materials

Paper at a basis weight of 75 kg/1000 $m^2$ was prepared from a combination of hard wood and soft wood pulps. The paper was sized internally with rosin size and alum and contained clay as a filler. The paper was dried before the size press to about 3% moisture.

A starch solution containing 8.5% ammonium persulfate converted starch by weight, to which varying amounts of polymer latex were added was used for application at the size press. Paper was surface sized with starch alone and with a combination of starch and latex:

| Sample | Starch Level (wt. % on dry paper) | Latex Level (wt. % on dry paper) |
|---|---|---|
| A | 5 | 0 (starch only) |
| B | 5 | 0.05 |

The product surface sized paper was evaluated for sizing using the Hercules Size Test (HST), and for ink jet print quality, i.e., optical density, feathering and wicking using black and colored inks. Relative toner adhesion was also determined. The results were as follows:

| | HST | Black Ink | | |
|---|---|---|---|---|
| Sample | (seconds) | Optical Density | Feathering | Wicking |
| A | 167 | 1.34 | acceptable | acceptable |
| B | 266 | 1.39 | acceptable | good |

| | Colored Ink | | |
|---|---|---|---|
| Sample | Composite Black Optical Density | Color-to Color Edge Roughness | Color-to-Color Line Growth |
| A | 0.87 | acceptable | acceptable |
| B | 0.88 | acceptable | good |

| Sample | Relative Toner Adhesion |
|---|---|
| A | 70 |
| B | 47 |

The data indicate that the paper surface sized with polymer latex by the process of the invention exhibits markedly better performance in black ink jet printing, somewhat better performance in color ink jet printing, and considerably improved performance in relative toner adhesion, than does paper sized with starch alone.

EXAMPLE 2

A polymer latex available as Carboset® GA1086 was obtained from B. F. Goodrich Co., Cleveland, Ohio. Dry polymer isolated from the latex (49% solids) was analyzed and found to comprise the monomers styrene, 2-ethylhexyl acrylate and acrylic acid. The polymer had acid number 50, $T_G$ of 12° C. and zeta potential from pH 5 to 9 that ranged from −29 to −35 millivolts.

A size press solution at pH 7.5 was prepared containing 7.3 wt. % of oxidized starch, 0.01% of an oil based defoamer and a low level of a benzothiazole based biocide. The polymer latex was added at a level to provide 0.30 wt. % polymer in the size press solution. The size composition was applied from the size press of a commercial paper machine in a quantity that provided a level of 0.13% by weight of the polymer in the dry paper.

The paper exhibited improved water hold out (sizing as measured by the Hercules Sizing Test) and improved ink jet printing quality. The final black and color ink jet print quality was acceptable-to-good based on Hewlett Packard standards.

After 10 hours of continual use on the paper machine, deposits in the machine were observed and traced to the use of the polymer latex. The deposits consisted of a slight build up of material at the screens where excess size press solution returned from the size press to the feed tank. This instability indicates that the zeta potential was not in the most preferred range of about −40 to −55 millivolts for best machine stability.

It is not intended that the examples presented here should be construed to limit the invention, but rather they are submitted to illustrate some of the specific embodiments of the invention. Various modifications and variations of the present invention can be made without departing from the scope of the appended claims.

What is claimed is:

1. A process for preparing sized paper comprising incorporating in the paper a size composition comprising polymer latex wherein the polymer contained in the polymer latex is anionic polymer having properties selected from the group consisting of $T_G$ about −15° C. to about 50° C. and acid number about 30 to about 100, wherein the polymer latex has a zeta potential of about −25 to about −70 millivolts over the pH range of about 5 to about 9, and wherein the solids level of polymer contained in the size composition is from about 0.02 to about 2 wt. %.

2. The process of claim 1 wherein the polymer latex has an average particle size of from about 30 to about 500 nanometers.

3. The process of claim 1 wherein the anionic polymer has properties selected from the group consisting of $T_G$ about 5° C. to about 35° C. and acid number about 40 to about 75, and wherein the polymer latex has a zeta potential of about −35 to about −60 millivolts over the pH range of about 5 to about 9.

4. The process of claim 1 wherein the anionic polymer has properties selected from the group consisting of $T_G$ about 20° C. to about 30° C. and acid number about 45 to about 55, and wherein the polymer latex has a zeta potential of about −40 to about −50 millivolts over the pH range of about 5 to about 9.

5. The process of claim 1 wherein the anionic polymer has a $T_G$ about −15° C. to 50° C. and an acid number about 30 to about 100, and wherein the polymer latex has a zeta potential of about −25 to about −70 millivolts over the pH range of about 5 to about 9.

6. The process of claim 1 wherein the sizing is surface sizing.

7. The process of claim 1 wherein the polymer contained in said polymer latex is an anionic copolymer of monomers comprising: (a) styrene or substituted styrene selected from the group consisting of α-methylstyrene and vinyl toluene; (b) alkyl acrylate or methacrylate; and (c) ethylenically unsaturated carboxylic acid.

8. The process of claim 1 wherein the polymer contained in said polymer latex is an anionic copolymer of monomers comprising: (a) styrene or substituted styrene selected from the group consisting of α-methylstyrene and vinyl toluene; (b) alkyl acrylate or methacrylate; and (c) ethylenically unsaturated carboxylic acid, wherein the alkyl group of the alkyl acrylate or methacrylate contains from about 1 to about 12 carbons atoms and wherein the ethylenically unsaturated carboxylic acid is selected from the group consisting of acrylic acid, methacrylic acid, maleic acid or anhydride, fumaric acid itaconic acid and mixtures thereof.

9. The process of claim 1 wherein the polymer contained in said polymer latex is an anionic copolymer of monomers comprising styrene, alkyl acrylate or methacrylate and ethylenically unsaturated carboxylic acid, wherein the alkyl acrylate or methacrylate is selected from the group consisting of methyl methacrylate, ethyl acrylate, ethyl methacrylate, propyl acrylate, butyl acrylate, butyl methacrylate, 2-ethylhexyl acrylate, 2-ethylhexyl methacrylate, lauryl acrylate, lauryl methacrylate and mixtures thereof and wherein the ethylenically unsaturated carboxylic acid is selected from the group consisting of acrylic acid and methacrylic acid.

10. Sized paper made by the process of claim 1.

11. A process for preparing sized paper comprising:

a) providing an aqueous pulp suspension;

b) sheeting and drying the aqueous pulp suspension to obtain paper;

c) applying to at least one surface of the paper an aqueous size composition comprising polymer latex; and d) drying the paper to obtain sized paper, wherein the polymer contained in the polymer latex is anionic polymer having properties selected from the group consisting of $T_G$ about −15° C. to about 50° C. and acid number about 30 to about 100, wherein the polymer latex has a zeta potential of about −25 to about −70 millivolts over the pH range of about 5 to about 9, and wherein the solids level of polymer contained in the size composition is from about 0.02 to about 2 wt. %.

12. The process of claim 11 wherein the polymer latex has an average particle size of from about 30 to about 500 nanometers.

13. The process of claim 11 wherein the anionic polymer has properties selected from the group consisting of $T_G$ about 5° C. to about 35° C. and acid number about 40 to about 75, and wherein the polymer latex has a zeta potential of about −35 to about −60 millivolts over the pH range of about 5 to about 9.

14. The process of claim 11 wherein the anionic polymer has properties selected from the group consisting of $T_G$ about 20° C. to about 30° C. and acid number about 45 to about 55, and wherein the polymer latex has a zeta potential of about −40 to about −55 millivolts over the pH range of about 5 to about 9.

15. The process of claim 11 wherein the anionic polymer has a $T_G$ about −15° C. to 50° C. and an acid number about 30 to about 100, and wherein the polymer latex has a zeta potential of about −25 to about −70 millivolts over the pH range of about 5 to about 9.

16. The process of claim 11 wherein the applying of step (c) takes place at a size press.

17. The process of claim 11 further comprising adding internal size to the aqueous pulp suspension prior to step (b).

18. The process of claim 17 wherein the internal size is selected from the group consisting of rosin size, ketene dimers, ketene multimers and alkenylsuccinic anhydrides.

19. The process of claim 11 wherein the anionic polymer is in the size composition at a level of about 0.05 wt. % to about 1 wt. % on a dry basis based on the total weight of the size.

20. The process of claim 11 wherein the aqueous size composition further comprises starch.

21. The process of claim 20 wherein the starch in the aqueous size composition is at a level of about 1 wt. % to about 20 wt. % on a dry basis based on the total weight of the aqueous size composition.

22. The process of claim 20 wherein the starch in the aqueous size composition is at a level of about 3 wt. % to about 15 wt. % on a dry basis based on the total weight of the aqueous size composition.

23. The process of claim 20 wherein the starch in the aqueous size composition is at a level of about 5 wt. % to about 10 wt. % on a dry basis based on the total weight of the aqueous size composition.

24. The process of claim 11 wherein the size is applied to paper at a level that provides about 0.02 wt. % to about 0.8 wt. % of the polymer on a dry basis based on the dry weight of the paper.

25. The process of claim 11 wherein the size is applied to paper at a level that provides about 0.05 wt. % to about 0.5 wt. % of the polymer on a dry basis based on the dry weight of the paper.

26. The process of claim 11 wherein the size is applied to paper at a level that provides about 0.1 wt. % to about 0.3 wt. % of the polymer on a dry basis based on the dry weight of the paper.

27. The process of claim 20 wherein the size is applied at a level that provides about 1 wt. % to about 8 wt. % starch on a dry basis based on the dry weight of the paper.

28. The process of claim 20 wherein the size is applied at a level that provides about 2 wt. % to about 6 wt. % starch on a dry basis based on the dry weight of the paper.

29. The process of claim 20 wherein the size is applied at a level that provides about 3 wt. % to about 5 wt. % starch on a dry basis based on the dry weight of the paper.

30. The process of claim 11 further comprising adding internal size to the aqueous pulp suspension prior to step (b), wherein the applying of step (c) takes place at a size press, and the polymer contained in the polymer latex is anionic polymer having properties selected from the group consisting of $T_G$ about 5° to about 35° and acid number about 40 to about 75, and wherein the polymer latex has a zeta potential of about −35 to about −60 millivolts over the pH range of about 5 to about 9.

31. The process of claim 30 wherein the size composition contains about 1% to about 20% by weight of starch and about 0.02% to about 2% by weight of the polymer present in the polymer latex, both on a dry basis, based on the total weight of the size, and wherein the size is applied at a level that provides about 0.02 wt. % to about 0.8 wt. % of the polymer and about 8 wt. % starch on a dry basis, based on the dry weight of the paper.

32. The process of claim 11 wherein the polymer contained in said polymer latex is an anionic copolymer of monomers comprising; (a) styrene or substituted styrene selected from the group consisting of α-methylstyrene and vinyl toluene; (b) alkyl acrylate or methacrylate; and (c) ethylenically unsaturated carboxylic acid.

33. The process of claim 11 wherein the polymer contained in said polymer latex is an anionic copolymer of monomers comprising styrene, alkyl acrylate or methacrylate and ethylenically unsaturated carboxylic acid, wherein the alkyl group of the alkyl group of the alkyl acrylate or methacrylate contains from about 1 to about 12 carbon atoms and wherein the ethylenically unsaturated carboxylic acid selected from the group consisting of acrylic acid, methacrylic acid, maleic acid or anhydride, fumaric acid, itaconic acid and mixtures thereof.

34. The process of claim 11 wherein the polymer contained in said polymer latex is an anionic copolymer of monomers comprising styrene, alkyl acrylate or methacrylate and ethylenically unsaturated carboxylic acid, wherein the alkyl acrylate or methacrylate is selected from the group consisting of methyl methacrylate, ethyl acrylate, ethyl methacrylate, propyl acrylate, butyl acrylate, butyl methacrylate, 2-ethylhexyl acrylate, 2-ethylhexyl methacrylate, lauryl acrylate, lauryl methacrylate and mixtures thereof and wherein the ethylenically unsaturated carboxylic acid is selected from the group consisting of acrylic acid and methacrylic acid.

35. Sized paper made by the process of claim 11.

36. The paper of claim 35 that performs better in ink jet printing than does paper that is the same except that it does not contain the size composition, when the printing is evaluated for at least one property selected from the group consisting of optical density, feathering, wicking, edge roughness and bleed.

37. The paper of claim 35 that has better toner adhesion than does paper that is the same except that it does not contain the size composition.

38. The paper of claim 35 that has a higher level of sizing than does paper that is the same except that it does not contain the size composition.

* * * * *